United States Patent [19]

Hafner et al.

[11] Patent Number: 5,038,738

[45] Date of Patent: Aug. 13, 1991

[54] FUEL INJECTION DEVICE FOR INTERNAL COMBUSTION ENGINES

[75] Inventors: Udo Hafner, Ludwigsburg; Peter Romann, Stuttgart, both of Fed. Rep. of Germany

[73] Assignee: Robert Bosch GmbH, Stuttgart, Fed. Rep. of Germany

[21] Appl. No.: 487,517

[22] Filed: Mar. 2, 1990

[30] Foreign Application Priority Data

Jun. 13, 1989 [DE] Fed. Rep. of Germany ..... 3919231

[51] Int. Cl.[5] ..... F02M 61/14

[52] U.S. Cl. ..... 123/470; 123/456; 123/468; 285/319

[58] Field of Search ..... 123/468, 469, 470, 471, 123/472; 239/550, 551, 532.2, 533.3, 600; 285/197, 319, 320, 330

[56] References Cited

U.S. PATENT DOCUMENTS

| | | | |
|---|---|---|---|
| 4,474,160 | 10/1984 | Gartner | 123/468 |
| 4,474,759 | 10/1984 | Katnik | 123/468 |
| 4,539,961 | 9/1985 | Atkins | 123/468 |
| 4,708,375 | 11/1987 | Sauer | 285/319 |
| 4,900,065 | 2/1990 | Houck | 285/319 |
| 4,929,002 | 5/1990 | Sauer | 285/319 |

FOREIGN PATENT DOCUMENTS

| | | | |
|---|---|---|---|
| 3406487 | 8/1985 | Fed. Rep. of Germany | 123/470 |
| 3428597 | 11/1986 | Fed. Rep. of Germany . | |
| 3074066 | 12/1986 | Fed. Rep. of Germany . | |

*Primary Examiner*—Carl Stuart Miller
*Assistant Examiner*—Erick Solis
*Attorney, Agent, or Firm*—Edwin E. Greigg; Ronald E. Greigg

[57] ABSTRACT

A fuel injection device for internal combustion engines including a fuel distributor which has a plurality of connection fittings with a radially protruding locking collar. A plurality of fuel injection valves embodied as so-called top-feed valves that are inserted in a liquid-tight manner into the connection fitting. For retention of the fuel injection valves these valves are provided with oppositely disposed catch springs which extend parallel to the valve axis and on faces oriented toward one another have a groove and locking protrusion for engaging the locking collar from behind.

3 Claims, 2 Drawing Sheets

FUEL INJECTION DEVICE FOR INTERNAL COMBUSTION ENGINES

BACKGROUND OF THE INVENTION

The invention is based on a fuel injection device for internal combustion engines as defined herein.

In a known fuel injection device of this type (German Patent 3,428,597), an interlocking of the injection valves on a locking collar of the connection piece is achieved by means of a U-shaped spring clamp, the crossbar of which extends transversely to the longitudinal extension of the fuel injection valve, and the legs of which on the one hand, with tabs thereon bent radially inward at the edge, engage the circumferential groove on the fuel injection valve and on the other hand have apertures into which the locking collar can snap into place on the connection fitting. For radial fixation of the spring clamp in the circumferential groove of the fuel injection valve, the tabs have sections of circular arc shape and concave extension, the radius of the sections corresponding to that of the circumferential grooves. During assembly, the spring clamp is first slipped onto the injection valve, and the legs snap into the circumferential groove. Then the injection valve, provided with the spring clamp, is thrust axially into the connection fitting. To allow the legs to slide along the locking collar, they are bent outward in the insertion direction and upon insertion are spread apart by the locking collar. As soon as the locking collar has snapped into place in the apertures, the legs snap back into their outset position.

OBJECT AND SUMMARY OF THE INVENTION

The fuel injection device according to the invention has an advantage of not requiring any additional components to affix the fuel injection valve in the connection fitting of the fuel distributor assembly which becomes substantially simpler, and easy removal is assured.

If the locking collar on the connection fitting of the fuel distributor is provided with fixation ribs that protrude approximately at a tangent, and if at least one catch spring is received between the fixation ribs, as in a preferred embodiment of the invention, then easy positional fixation against rotation in the circumferential direction can be achieved. This kind of positional fixation is of essential significance for multi-stream injection valves, in which the stream planes must assume a predetermined positioning with respect to the geometry of the engine intake.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
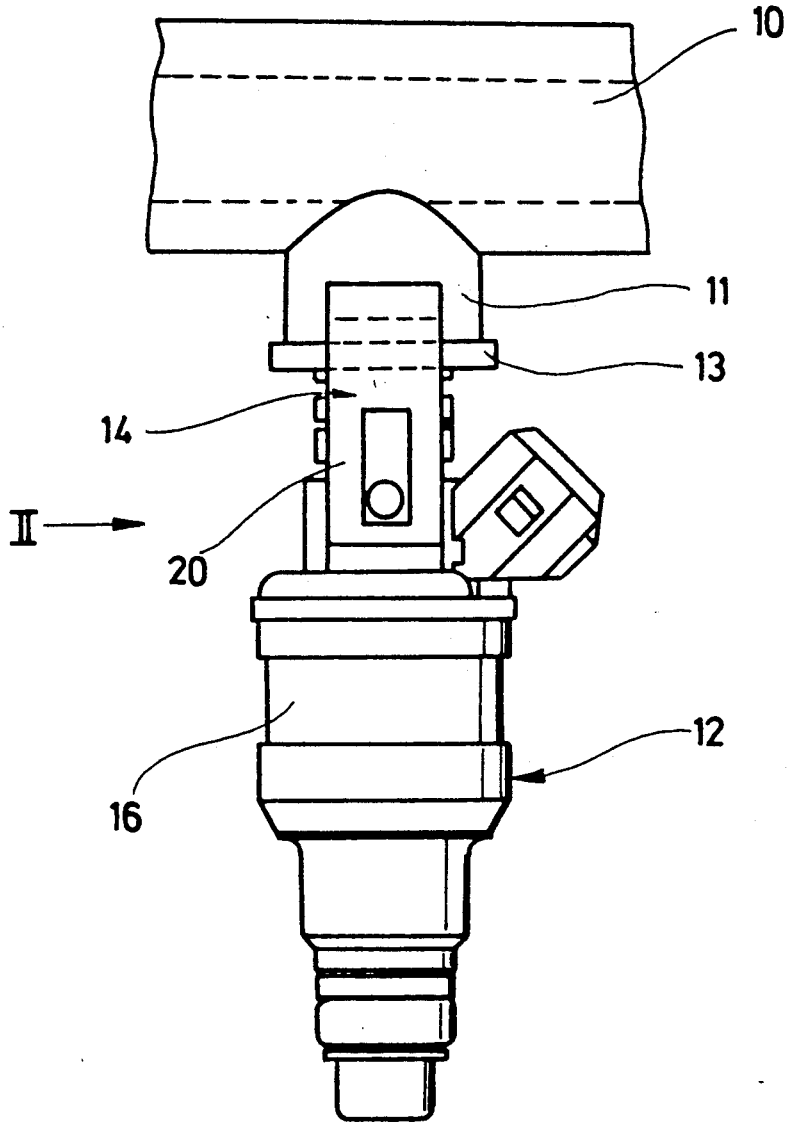
FIG. 1 is a detail showing a side view of a fuel injection device with a fuel distributor and one of a plurality of fuel injection valves.
Figure 2:
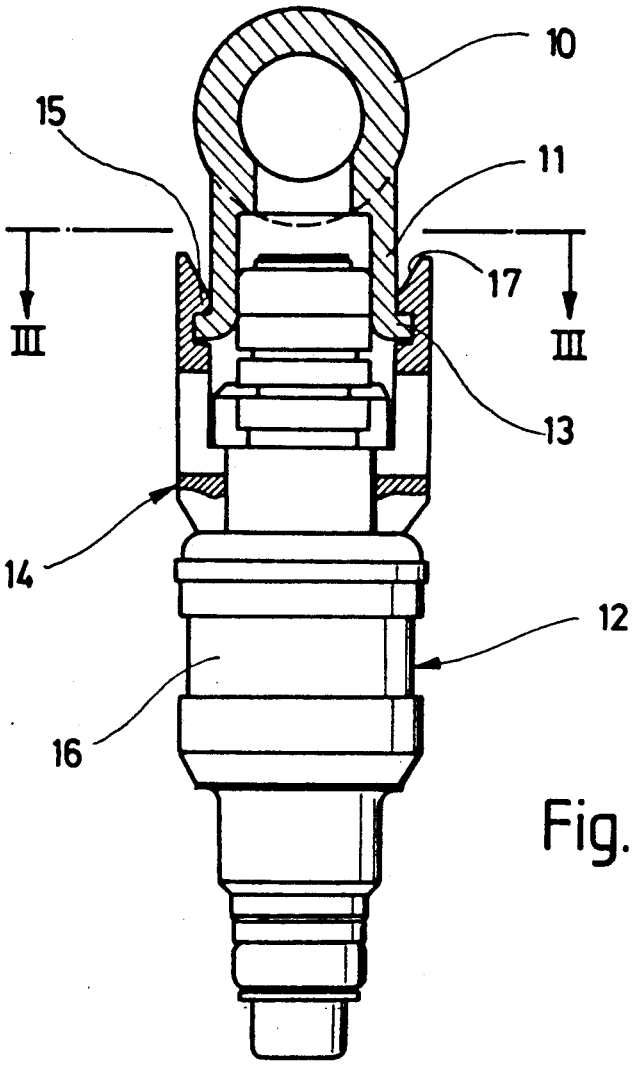
FIG. 2 is a partial cross sectional view of the fuel injection device in the direction of the arrow II of FIG. 1.
Figure 3:
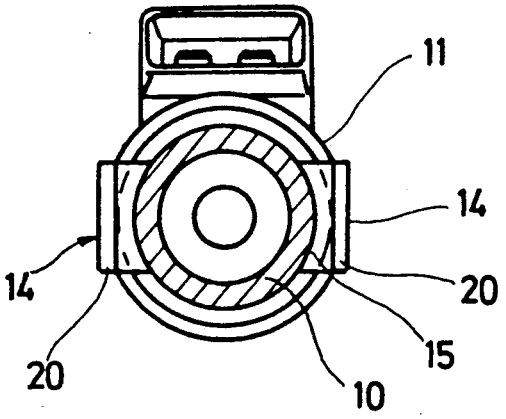
FIG. 3 is a section taken along the line III—III of FIG. 2.

The fuel injection device for internal combustion engines shown in two different side views, and partly in section, in FIGS. 1 and 2 has a fuel distributor line 10 of plastic or die-cast aluminum, which has a plurality of connection fittings 11 along its length, and an identical number of fuel injection valves 12, with a connection opening present on the connection end of the connection opening for supplying fuel. Such fuel injection valves 12 are generally known as top-feed valves. The number of connection fittings 11 and fuel injection valves 12 depend on the number of engine cylinders to be supplied. With a four-cylinder engine, four fuel injection valves 12 should be provided, each inserted in a fluid-tight manner into one of four connection fittings 11 in the fuel distributor 10.

For retaining the fuel injection valves 12, each connection fitting 11 is provided on its free connection end with a radially protruding cylindrical locking collar or shoulder 13, and each fuel injection valve 12 is provided with two oppositely disposed catch springs 14, which extend parallel to the axis of the fuel injection valve 12 and have corresponding grooves therein which form one locking protrusion 15 each on faces oriented toward one another. The two catch springs 14 and the locking protrusion 15 are integrally molded in the form of spring legs 20 diametrically opposite the valve axis to the housing 16 of the fuel injection valve 12 by injection molding, and they extend radially spaced apart from the housing 16 as far as the connection end having the connection opening. On the end of each spring leg 20, the spring leg is provided with a lift-out incline 17, which extends obliquely outward toward the connection end of the leg from the faces oriented toward one another of the spring legs 20.

If the fuel injection valve 12 is now inserted with its connection end having the connection opening into the connection fitting 11, the two catch springs 14 spread open and slide over the locking collar 13 on the connection fitting 11. This spreading apart is assured by means of the lift-out inclines 17. As soon as the locking protrusions 15 slide past the locking collar 13, the locking collar seats in the grooves in the legs and the catch springs 14 return to the outset position, and the locking protrusions 15 engage the locking collar 13 from behind, so that the fuel injection valve 12 is securely locked into place on the connection fitting 11. For removal, the catch springs 14 should be pressed outward by a tool until the locking protrusions 15 release the locking collar 13. The fuel injection valve 12 can then be pulled from the connection fitting 11. The lift-out inclines 17 make it easier to introduce the removal tool and to connect the valve to the connector of the fuel distributor line.

Figure 4:
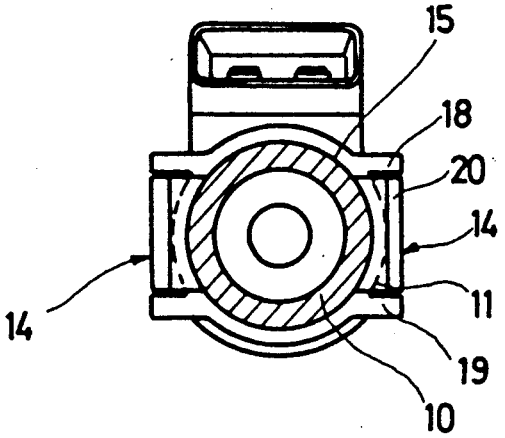
FIG. 4 is a view similar to that of FIG. 3 of a fuel injection device in accordance with a further exemplary embodiment.

So-called multi-stream fuel injection valves require exact positioning in the connection fitting 11, and must not rotate circumferentially either during assembly or during operation; otherwise, mixture preparation would be markedly impaired. This kind of protection against twisting is provided in the fuel injection device shown in FIG. 4, which shows a section taken through the fuel injection device along the line III—III of FIG. 2. The locking collar 13 has two pairs of space fixation ribs 18, 19, which extend outward past the locking collar 13 approximately at a tangent. The inside distance between one pair of fixation ribs 18, 19 is equivalent to the width of the spring legs 20, each spring leg 20, reaching with its locking protrusion 15 over the locking collar 13, rests on both sides on a respective fixation rib 18 or 19. Once the fuel injection valve 12 has snapped into place on the connection fitting 11, the valve can no longer be rotated circumferentially. The position of the fixation ribs 18, 19 is defined in accordance with the required position of the fuel injection valve 12.

The foregoing relates to a preferred exemplary embodiment of the invention, it being understood that other variants and embodiments thereof are possible within the spirit and scope of the invention, the latter being defined by the appended claims.

What is claimed and desired to be secured by letters patent of the United States is:

1. A fuel injection device for internal combustion engines having a fuel distributor line, said fuel distributor line includes a plurality of connection fittings with a radially protruding locking collar on its end, a plurality of fuel injection valves each of which include a housing (16), each of said injection valves include a connection end having a connection opening which connection end is inserted into a respective connection fitting in a liquid-tight manner, each fuel injection valve (12) is provided with at least two opposing disposed catch springs (14), which extend parallel to the axis of the fuel injection valve (12), each of said catch springs include faces oriented toward one another, each of said faces include corresponding grooves that form a transversely protruding locking protrusion (15) for grasping the locking collar (13) on the connection fitting (11) from behind, and said catch springs (14) including said locking protrusions (15) include a connection end and are injection molded in the form of spring legs (20) integrally with said housing (16) of the fuel injection valves (12).

2. A fuel injection device as defined by claim 1, in which each of said catch springs have one liftout incline (17) each on their connection end, which extend outward toward the connection end of said injection valve from the leg face oriented toward the opposing catch spring.

3. A fuel injection device as defined by claim 1, in which said radially protruding locking collar includes two fixation ribs (18, 19) that protrude approximately at a tangent from the locking collar (13), and that at least one catch spring rests between each two fixation ribs (18, 19) substantially without play.

* * * * *